US005166026A

United States Patent [19]

Fuller et al.

[11] Patent Number: 5,166,026

[45] Date of Patent: Nov. 24, 1992

[54] TONER AND DEVELOPER COMPOSITIONS WITH SEMICRYSTALLINE POLYOLEFIN RESINS

[75] Inventors: Timothy J. Fuller, Henrietta, N.Y.; Stephan Drappel, Toronto, Canada; Thomas W. Smith, Penfield, N.Y.; Michael J. Levy, Webster, N.Y.; Richard B. Lewis, Williamson, N.Y.; Ralph A. Mosher, Rochester, N.Y.

[73] Assignee: Xerox Corporation, Stamford, Conn.

[21] Appl. No.: 621,704

[22] Filed: Dec. 3, 1990

[51] Int. Cl.[5] ..... G03G 9/083

[52] U.S. Cl. ..... 430/106; 430/109; 430/110; 430/126; 525/241; 526/348.2; 526/348.3; 526/348.4; 526/348.5

[58] Field of Search ..... 430/106, 106.6, 109, 430/110, 126; 526/348.3–348.5, 348.2; 525/241

[56] References Cited

U.S. PATENT DOCUMENTS

| | | | |
|---|---|---|---|
| 3,590,000 | 6/1971 | Palermiti et al. | 252/62.1 |
| 3,853,778 | 12/1974 | Buckley et al. | 252/62.1 |
| 3,967,962 | 7/1976 | O'Malley | 96/15 D |
| 4,448,871 | 5/1984 | Tamaki et al. | 430/109 |
| 4,529,680 | 7/1985 | Asanae et al. | 430/106.6 |
| 4,609,607 | 9/1986 | Takagi et al. | 430/106.6 |
| 4,610,944 | 9/1986 | Matsumoto et al. | 430/135 |
| 4,810,612 | 3/1989 | Ueda et al. | 430/109 |
| 4,952,477 | 8/1990 | Fuller et al. | 430/109 |
| 4,990,424 | 2/1991 | Van Dusen et al. | 430/106.6 |

*Primary Examiner*—Marion E. McCamish
*Assistant Examiner*—S. Rosasco
*Attorney, Agent, or Firm*—E. O. Palazzo; John L. Haack

[57] ABSTRACT

A toner composition comprised of semicrystalline copolymer resin particles with a melting point of from about 30° C. to about 100° C., and containing functional groups comprising hydroxy, carboxy, amino, amido, ammonium or halo, and pigment particles.

34 Claims, No Drawings

TONER AND DEVELOPER COMPOSITIONS WITH SEMICRYSTALLINE POLYOLEFIN RESINS

BACKGROUND OF THE INVENTION

This invention is generally directed to toner compositions, and more specifically, the present invention relates to developer compositions having incorporated therein toner compositions comprised of poly(alpha-olefin) copolymer resins. More specifically, in one embodiment of the present invention there are provided developer compositions formulated by admixing toner compositions containing toner polymeric resins, and carrier components. In one specific embodiment of the present invention there are provided toner compositions with poly(alpha-olefin) derived copolymers of the formula poly($A_n$—$B_m$), that is for example copolymers such as ($A_n$—$B_m$) wherein n represents the approximate number of A monomers of type A, and m represents the approximate number of B monomers of type B, which copolymer compositions in embodiments enable a desirable low fusion and fusing energy; are easily jettable or processable into toner compositions; are optically opaque providing, for example, reduced objectionable gloss to color and particularly to matte black copies and prints; and with the copolymers illustrated herein there can, in several embodiments, be fabricated brittle, rubbery, or other similar toner polymers with an optimized melt viscosity profile, that is for example added monomers that extend the copolymer chain and increase the molecular weight and melt viscosity of the resulting polymer without substantially adversely influencing the fusion and fusing properties of the toner. Also, toner compositions formulated with the aforementioned copolymers have similar advantages as illustrated herein. Thus, for example, the toner compositions of the present invention possess low fusing temperatures, and therefore lower fusing energies are required for fixing, thus enabling less power consumption during fusing, and permitting extended lifetimes for the fuser systems selected and therefore enhanced copy machine reliability. Accordingly, therefore, the toners of the present invention in embodiments can be fused (fuser roll set temperature) at temperatures of between 200° and 250° F. or less, as compared to many currently commercially available toners which fuse at temperatures of from about 300° to about 325° F. The aforementioned polymers enable fusing systems that do not require a silicone or related oil fluid to release fused copies and toner from the fuser roll. Specifically, the copolymers poly($A_n$—$B_m$), that is of the formula ($A_n$—$B_m$), of the present invention wherein A is a first monomer, such as eicosene, and B is a second monomer such as styrene, eicosene, eicosene derivatives selected from the group hydroxy, halide, quaternary ammonium, amine and amide, or undecylenic acid or undecylenic acid derivatives selected from the group hydroxy, halide, quaternary ammonium, amine, amide, carboxylic acid, alkali metal salts, alkyl and aryl acid esters, and trialkylsilyl acid ester, which poly(alpha-olefin) copolymers have determined, for example, upon the amount of catalyst used an estimated number average molecular weight of from about 2,000 to about 1,500,000 and preferably from about 10,000 to about 100,000. Also, the toner and developer compositions of the present invention are particularly useful in electrophotographic imaging and printing systems, especially xerographic imaging processes that are designed for the generation of low energy fusing, preferably matte finish black images.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions are the appropriate triboelectric charging values associated therewith, as it is these values that enable continued constant developed images of high quality and excellent resolution, and admixing characteristics. Specifically, thus toner and developer compositions are known, wherein there are selected as the toner resin styrene acrylates, styrene methacrylates, and certain styrene butadienes including those available as Pliolites®. Other resins have also been selected for incorporation into toner compositions inclusive of the polyesters as illustrated in U.S. Pat. No. 3,590,000. Moreover, it is known that single component magnetic toners can be formulated with styrene butadiene resins, particularly those resins available as Pliolite. In addition, positively charged toner compositions containing various resins, inclusive of certain styrene butadienes and charge enhancing additives, are known. For example, there are described in U.S. Pat. No. 4,560,635, the disclosure of which is totally incorporated herein by reference, positively charged toner compositions with distearyl dimethyl ammonium methylsulfate charge enhancing additives. The '635 patent also illustrates the utilization of suspension polymerized styrene butadienes for incorporation into toner compositions, reference for example working Example IX contained therein.

Numerous U.S. Pat. Nos. are in existence that illustrate toner compositions with various types of toner resins including, for example, 4,104,066, polycaprolactones; 3,547,822, polyesters; 4,049,447, polyesters; 4,007,293, polyvinyl pyridine-polyurethane; 3,967,962, polyhexamethylene sebaccate; 4,314,931, polymethyl methacrylates; Reissue 25,136, polystyrenes; and 4,469,770, styrene butadienes.

In a patentability search report the following United States patents were listed:

| |
|---|
| U.S. Pat. No. 3,967,962<br>Patentee: O'Malley<br>Issued: July 6, 1976 |
| U.S. Pat. No. 4,810,612<br>Patentee: Ueda et al.<br>Issued: March 7, 1989 |
| U.S. Pat. No. 4,448,871<br>Patentee: Tamaki et al.<br>Issued: May 15, 1984 |
| U.S. Pat. No. 3,853,778<br>Patentee: Buckley et al.<br>Issued: December 10, 1974 |
| U.S. Pat. No. 4,610,944<br>Patentee: Matsumoto et al.<br>Issued: September 9, 1986 |

O'Malley, for example, discloses an imaging process employing a semicrystalline toner resin comprised of segmented block or graft copolymers consisting of at least one crystalline or crystallizable polymeric segment chemically linked, typically by a urethane coupling agent, to at least one amorphous polymeric segment. Specifically disclosed is, for example, a toner resin comprised of a copolymer containing poly(1-hexadecene).

Ueda discloses toner compositions made from resins comprised of graft modified polyolefin waxes, wherein polyolefins having 2 to 10 carbon atoms are preferred, and more specifically polyolefins prepared from alpha-olefins having 2 to 10 carbon atoms and grafted thereto are monomers selected from the group consisting of acrylonitrile or methacrylonitrile, aromatic carboxylic acid vinyl ester and unsaturated carboxylic acid esters.

Tamaki discloses a toner composition and method for making said toner wherein the toner resin is comprised of random copolymers comprised of alpha olefins in the alkene series of $C_2$ to $C_{10}$ and isomers thereof.

Buckley, for example, discloses a toner resin comprised of a polymer selected from the group consisting of a crystalline homopolymer or copolymer having an amorphous backbone and side-chain crystallinity derived from polymerizable monomers having at least 14 carbon atoms.

Matsumoto discloses a process for producing a toner composition that comprises initially forming a hot melt mixture of monomeric long chain hydrocarbons or alpha olefins such as eicosene, a colorant and a dispersant.

Of interest is U.S. Pat. No. 4,529,680, which discloses magnetic toners for pressure fixation containing methyl-1-pentene as the main component. More specifically, there is illustrated in this patent, reference column 2, beginning at line 66, magnetic toners with polymers containing essentially methyl-1-pentene as the main component, which polymer may be a homopolymer or copolymer with other alpha-olefin components. It is also indicated in column 3, beginning at around line 14, that the intrinsic viscosity of the polymer is of a specific range, and further that the melting point of the polymer is in a range of 150° to 240° C., and preferably 180° to 230° C. Other U.S. Pat. Nos. of background interest include 3,720,617; 3,752,666; 3,788,994; 3,983,045; 4,051,077; 4,108,653; 4,258,116 and 4,558,108.

Furthermore, a number of different carrier particles have been illustrated in the prior art, reference for example the 3,590,000 patent mentioned herein; and U.S. Pat. No. 4,233,387, the disclosure of which is totally incorporated herein by reference, wherein coated carrier components for developer mixtures, which are comprised of finely divided toner particles clinging to the surface of the carrier particles, are recited. Specifically, there are disclosed in this patent coated carrier particles obtained by mixing carrier core particles of an average diameter of from between about 30 microns to about 1,000 microns with from about 0.05 percent to about 3.0 percent by weight based on the weight of the coated carrier particles of thermoplastic resin particles. More specifically, there are illustrated in the '387 patent processes for the preparation of carrier particles by a powder coating process; and wherein the carrier particles consist of a core with a coating thereover comprised of polymers. The carrier particles selected can be prepared by mixing low density porous magnetic, or magnetically attractable metal core carrier particles with from, for example, between about 0.05 percent and about 3 percent by weight based on the weight of the coated carrier particles of a polymer until adherence thereof to the carrier core by mechanical impaction or electrostatic attraction; heating the mixture of carrier core particles and polymer to a temperature, for example, of between from about 200° F. to about 550° F. for a period of from about 10 minutes to about 60 minutes enabling the polymer to melt and fuse to the carrier core particles; cooling the coated carrier particles; and thereafter classifying the obtained carrier particles to a desired particle size. In U.S. Pat. Nos. 4,937,166 and 4,935,326, the disclosures of which are totally incorporated herein by reference, there are disclosed carrier particles comprised of a core with a coating thereover comprised of a mixture of a first dry polymer component and a second dry polymer component not in close proximity to the first polymer in the triboelectric series. Therefore, the aforementioned carrier compositions can be comprised of known core materials including iron with a dry polymer coating mixture thereover. Developer compositions can be generated by admixing the aforementioned carrier particles with a toner composition comprised of the resin particles of the present invention and pigment particles. Other U.S. Pat. Nos. of interest include 3,939,086, which discloses steel carrier beads with polyethylene coatings, see column 6; 3,533,835; 3,798,167; 3,918,968; 3,922,382; 4,238,558; 4,310,611; 4,397,935 and 4,434,220, the disclosures of which are totally incorporated herein by reference.

In copending application U.S. Ser. No. 751,922 (abandoned) entitled "Developer Compositions With Specific Carrier Particle Developers", the disclosure of which is totally incorporated herein by reference, there are illustrated toners with styrene butadiene copolymers, pigment particles inclusive of magnetites, charge control additives, and carrier particles containing a core with a coating thereover of vinyl copolymers or homopolymers, such as vinyl chloride/vinyl acetate.

Additionally of interest with respect to the toner resins and toners of the present application are the semicrystalline polyolefin resins or blends thereof illustrated in U.S. Pat. No. 4,952,477 and copending applications U.S. Pat. No. 4,990,424 (D/87152), and liquid glass multiblock copolymer resins illustrated in U.S. Ser. No. 587,194 (D/89064), the disclosures of which are totally incorporated herein by reference. More specifically, in the '477 patent there are disclosed toners with semicrystalline polyolefin polymer or polymers with a melting point of from about 50° to about 100° C., and preferably from about 60° to about 80° C. with the following formulas wherein the subscript x is a number of from about 250 to about 21,000; the number average molecular weight is from about 17,000 to about 1,500,000 as determined by GPC; and the $M_w/M_n$ dispersability ratio is from about 2 to about 15.

| | |
|---|---|
| I. | Polypentenes - $(C_5H_{10})_x$ |
| II. | Polytetradecenes - $(C_{14}H_{28})_x$ |
| III. | Polypentadecenes - $(C_{15}H_{30})_x$ |
| IV. | Polyhexadecenes - $(C_{16}H_{32})_x$ |
| V. | Polyheptadecenes - $(C_{17}H_{34})_x$ |
| VI. | Polyoctadecenes - $(C_{18}H_{36})_x$ |
| VII. | Polynonadecenes - $(C_{19}H_{38})_x$; and |
| VIII. | Polyeicosenes - $(C_{20}H_{40})_x$. |

Examples of specific semicrystalline polyolefin polymers illustrated in this copending application include poly-1-pentene; poly-1-tetradecene; poly-1-pentadecene; poly-1-hexadecene; poly-1-heptadecene; poly-1-octadene; poly-1-nonadecene; poly-1-eicosene; mixtures thereof; and the like.

Principal advantages of the copolymers of the instant invention over the aforementioned crystalline and semicrystalline copolymers include improved jetting rate; improved control of tribocharging properties of the resultant toner composition by incorporation of functional groups into the resin; improved control of the melt viscosity and rheology providing a broader fusing latitude of the toner composition; and a reduced tendency of the resultant toner composition to vinyl offset, that is to transfer from paper to a vinyl surface as found in ring notebook binders, when fused to, for example, paper copy sheets.

Although the above described toner compositions and resins are suitable for their intended purposes, including those of U.S. Pat. No. 4,592,477 and copending application U.S. Ser. No. 231,428, U.S. Pat. No. 4,990,424 there continues to be a need for toner and developer compositions containing new resins. More specifically, there is a need for toners which can be fused at lower energies than many of the presently available resins selected for toners. There is also a need for resins that can be selected for toner compositions which are low cost, nontoxic, nonblocking at temperatures of less than 50° C., jettable, melt fusible with a broad fusing latitude, cohesive above the melting temperature, and triboelectrically chargeable and stable. In addition, there remains a need for toner compositions which can be fused at low temperatures, that is for example of between 200° and 250° F. or less, as compared to a number of toners presently in commercial use, which require fusing temperatures of about 300° to 325° F., thereby enabling, with the compositions of the present invention, the utilization of lower fusing temperatures, and lower fusing energies permitting less power consumption during fusing, and allowing the fuser system, particularly the fuser roll selected, to possess extended lifetimes. Another important need exists for toner resins which enable fuser systems to function without silicone or related release agent oils that function to release fused copies from the fuser roll. Another need resides in the provision of developer compositions comprised of the toner compositions illustrated herein, and carrier particles. There also remains a need for toner and developer compositions containing additives therein, for example charge enhancing components, thereby providing positively, or negatively charged toner compositions. Furthermore, there is a need for toner and developer compositions with copolymers that will enable the generation of solid image area with substantially no background deposits, and full gray scale production of half tone images in electrophotographic imaging and printing systems. Also, the toner compositions of the present invention may be selected for imaging and printing processes wherein silicone oils, or release fluids are avoided, or minimized.

There is also a need for polymers, in particular copolymers, and mixtures of the aforementioned copolymers with melting points of from about 30° to about 100° C., and preferably from about 40° to about 60° C.; and wherein toner compositions containing the aforementioned resins can be formulated into developer compositions which are useful in electrophotographic imaging and printing systems, and wherein fusing can, for example, be accomplished by flash, radiant, with heated ovens, and cold pressure fixing methods.

SUMMARY OF THE INVENTION

It is a feature of the present invention to provide toner and developer compositions which possess many of the advantages illustrated herein.

In another feature of the present invention there are provided developer compositions with positively charged toners containing therein low melt copolymer resins.

Also, in another feature of the present invention there are provided toner compositions containing therein a copolymer or mixture of copolymers of the formula poly($A_n$—$B_m$), that is ($A_n$—$B_m$) as resinous components, which components have a melting point of from about 30° to about 100° C., and preferably from about 40° to about 60° C.

Further, in an additional feature of the present invention there are provided developer compositions comprised of toners having incorporated therein copolymer resins, and carrier particles.

In another feature of the present invention there are provided toner resins which allow release of the toner fused copy sheet from the fuser system without the need for an oil release agent.

Another need provided by the toner resins of the instant invention are fused images which do not vinyl offset, that is wherein the toner image fused onto a paper copy sheet does not readily transfer the image to a vinyl surface as, for example, found in the materials of construction for many ringed binder notebooks.

Furthermore, in another feature of the present invention there are provided improved toner compositions which can be fused at lower temperatures thereby reducing the amount of energy needed for affecting fusing of the image developed.

Moreover, in another feature of the present invention there are provided developers with positively and negatively charged toner compositions that possess excellent electrical properties.

Also, in another feature of the present invention, there are provided developers with stable triboelectric charging characteristics for extended time periods exceeding, for example, 1,000,000 imaging cycles.

Another feature of the present invention resides in the provision of toner compositions with excellent blocking temperatures and fusing temperature latitudes.

In another feature of the present invention there are provided toner and developer compositions that are nontoxic, nonblocking at temperatures of less than 50° C., jettable, melt fusible with a broad fusing latitude, and cohesive above the melting temperature thereof.

Furthermore, in an additional feature of the present invention there are provided developer compositions containing carrier particles with a coating thereover comprised of a mixture of polymers that are not in close proximity in the triboelectric series, reference U.S. Pat. Nos. 4,937,166 and 4,935,326, the disclosures of which are totally incorporated herein by reference.

Also, in yet still another feature of the present invention there are provided methods for the development of electrostatic latent images with toner compositions containing therein copolymers as resin particles.

In yet another feature of the present invention there are provided developer compositions with carrier components obtained by a dry coating process, which particles possess substantially constant conductivity parameters, and a wide range of preselected triboelectric charging values.

Furthermore, in yet a further feature of the present invention there are provided developer compositions with carrier particles comprised of a coating with a mixture of polymers that are not in close proximity, that is, for example, a mixture of polymers from different positions in the triboelectric series, and wherein the toner compositions incorporated therein possess excellent admix charging values of, for example, less than one minute, and triboelectric charges thereon of from about 10 to about 40 microcoulombs per gram.

Another feature of the present invention resides in the provision of toner and developer compositions which are insensitive to humidity of from about 20 to about 90 percent, and which compositions possess superior aging characteristics enabling their utilization for a substantial number of imaging cycles with very little modification of the triboelectrical properties, and other characteristics.

Also, in another feature of the present invention there are provided low melting toner compositions.

In still another feature of the present invention there are provided toner and developer compositions for affecting development of images in electrophotographic imaging apparatus, including xerographic imaging, and printing processes.

In another feature of the present invention there are provided toner and developer compositions comprised of toner resins that possess excellent lubricity properties and therefore avoid the need for external or internal wax additives for smear resistance, can be selected as a photoreceptor cleaning aid, as a fuser release agent, or as a toner developer anticaking additive.

These and other features of the present invention can be accomplished by providing toner and developer compositions. More specifically, in one embodiment of the present invention there are provided toner compositions comprised of pigment particles, and copolymers. The aforementioned copolymers in embodiments possess a melting point of from about 30° to about 100° C., and preferably from about 40° to about 60° C. as determined by differential scanning calorimetry.

Examples of advantages of the semicrystalline copolymer resin of the present invention include their low cost since the starting material monomers are inexpensive and readily available and because these resins are processable into toner by conventional jetting methods, that is for example using a jet mill available commercially as, for example, from Alpine, Alljet, Sturtevant, and the like. Furthermore, resins of the type described herein are not prone to vinyl offset, that is a reduced tendency of the resultant toner composition to transfer from a paper to a vinyl surface as found in ring notebooks when fused to, for example, paper copy sheets.

More specifically, in one embodiment the poly(alpha-olefin)copolymers of the present invention are of the formula $(A_n—B_m)$ wherein, A are polymeric segments derived from A monomers, B are polymeric segments derived from B monomers, n is a whole number and represents the approximate number of A monomers in the A polymeric segments, and m is a whole number and represents the approximate number of B monomers in the B polymeric segments. The copolymers of the present invention usually contain at least 10 A monomers, and at least 10 B monomers, and may contain up to 21,000 A and 21,000 B monomer units in the copolymer. The number average molecular weight of the copolymers of the present invention depends on the total number of A and B segments, the toner properties desired, and the like. Generally, however, the number average molecular weight is from about 2,000 to about 1,500,000 and preferably from about 10,000 to about 100,000.

Examples of poly$(A_n—B_m)$ copolymers of the present invention include those of the aforementioned formula wherein A represents a first oligomeric or polymeric segment derived from A monomers and B represents a second oligomeric or polymeric segment derived from B monomers wherein n is a number of from about 10 to about 21,000; m is a number of from about 10 to about 21,000; A is eicosene; and B is selected from the group comprised of styrene, undecylenyl alcohols, undecylenyl halides, undecylenic acid, undecylenic acid metal salts, alkyl and aryl undecylenic acid esters, trialkyl silyl undecylenic acid esters, iodoeicosene, quaternary ammonium eicosene, amino eicosene, amido eicosene, and the like.

Specific copolymers of poly$(A_n—B_m)$ include, for example, combinations of the following pairs of A and B monomers: eicosene and styrene; eicosene and undecylenyl derivatives such as undecylenyl, especially aliphatic alcohols, alcohols; halides; quaternary ammonium salts; amines; amides; carboxylic acids; alkali metal salts of the carboxylic acids; alkyl and aryl acid esters; and trialkylsilyl acid esters.

More specifically, the copolymer or copolymer blends with a melting point of about 30° to about 100° C., and preferably from about 40° to about 60° C. selected for the toner compositions of the present invention are illustrated with respect to the following formulas:

| | |
|---|---|
| I. | Poly[(eicosene)$_n$-(styrene)$_m$] |
| II. | Poly[(eicosene)$_n$-(undecylenyl alcohol)$_m$] |
| III. | Poly[(eicosene)$_n$-(undecylenyl halides)$_m$] |
| IV. | Poly[(eicosene)$_n$-(undecylenic acid)$_m$] |
| V. | Poly[(eicosene)$_n$-(iodoeicosene)$_m$] |
| VI. | Poly[(eicosene)$_n$-(undecylene quaternary ammonium salt)$_m$] |
| VII. | Poly[(eicosene)$_n$-(aminoundecylene)$_m$] |
| VIII. | Poly[(eicosene)$_n$-(trialkylsilyl undecylenic acid esters)$_m$] |
| IX. | Poly[(eicosene)$_n$-(amidoeicosene)$_m$] |
| X. | Poly[(eicosene)$_n$-(alkyl undecylenate)$_m$] |
| XI. | Poly[(eicosene)$_n$-(undecylenic acid metal salts)$_m$]; and |
| XII. | Poly[(eicosene)$_n$-(undecylenyl halide)$_m$] - graft polyethyloxazoline |

wherein n is a number of from 10 to about 21,000; and m is a number of from 10 to about 21,000.

In an embodiment, the toner composition of the present invention is comprised of a mixed poly(alpha olefin) $(A_n—B_m)$ comprised of components selected from the group consisting of eicosene of from about 25 to about 90 weight percent and styrene; eicosene and undecylenyl halides of from about 10 to about 50 weight percent; eicosene and undecylenyl alcohol of from about 10 to about 45 weight percent; eicosene and undecylenyl acid of from about 2 to about 30 weight percent; eicosene and alkali metal salts of undecylenyl acid of from about 2 to about 30 weight percent; eicosene and alkyl and aryl undecylenic acid esters of from about 2 to about 30 weight percent; eicosene and trialkylsilyl undecylenic acid esters of from about 2 to about 30 weight percent; eicosene and iodoeicosene of from about 10 to about 50 weight percent; eicosene and quaternary ammonium undecylene of from about 2 to about 50 weight percent; eicosene and amino undecylene of from about 10 to about 50 weight percent; and eicosene and amido undecylene of from about 10 to about 50 weight percent and eicosene and undecylenyl halides of from about 10 to about 50 weight percent containing graft polyethyloxazoline.

The copolymers described herein for use in xerographic toners can be prepared by the Ziegler-Natta polymerization of the alkene eicosene with olefinic monomers such as styrene, undecylenyl chloride, bromide, and iodide, undecylenyl alcohol (as the trimethyl silyl ether); and undecylenic acid (as the trimethyl silyl ester). One catalyst that was selected for the process was $TiCl_3$—AA/$Et_2AlCl$ (Ziegler-Natta isotactic catalyst), a highly specific isotactic catalyst for the polymerization of alpha-olefins. The reactions are generally carried out by preparing an anhydrous solution, for example, in toluene of the olefin monomers, for example the combinations as listed in the above paragraph, thereafter adding catalytic amounts of, for example, a toluene solution containing diethyl aluminum chloride and then titanium trichloride. Stirring the reaction mixture under inert atmosphere at elevated temperatures, for example 50° to 180° C., for several hours to several days followed by quenching with, for example, methanol and precipitating the product with acidic methanol affords the copolymer product. Amino-, amido-, and quaternary ammonium salt-derivatives were prepared by nucleophilic substitution reactions of amines on halo-containing monomers such as undecylenyl iodide and polymers such as polyeicosene-undecylenyl iodide. Some of the various polymers prepared are described below. The weight ratio of monomers used to prepare the copolymers of the present invention are given in the corresponding tables and/or working examples.

Eicosene-Styrene Copolymers

Copolymers of eicosene and styrene with a variety of styrene loadings (5, 10, 25, 50, 75, 90 and 95 weight percent) which were melt extrudable at 120° C., jettable and triboelectrically chargeable were prepared generally as described herein. A series of specific materials are given in the Examples and accompanying Tables. Moreover, excellent low temperature fusing characteristics of from about 200° to about 275° F., and preferably from about 200° to about 225° F., were observed along with reasonable fusing latitudes for the aforementioned copolymers. Compositions of styrene and eicosene were determined using $^1H$ NMR spectrometry with copolymer samples dissolved in $CDCl_3$ and by solid state cross-polarization $^{13}C$ NMR spectrometry with powdered samples of the copolymers packed in a sapphire rotor. The weight percent of styrene obtained in the copolymers was comparable with the feed ratio of styrene charged at the beginning of the reaction at loadings between 10 and 75 weight percent of styrene over the range examined. Thermal analysis of the products was carried out using differential scanning calorimetry (DSC). The DSC thermograms are consistent with semicrystalline melting endotherms in samples between 0 and 75 weight percent of styrene with eicosene. No melting peak endotherm was observed in a sample made from 95 weight percent of styrene with eicosene. However, a glass transition temperature between 53.5° and 58° C. was indicative of amorphous glassy behavior. The polymers described are highly isotactic. Soluble extracts of the copolymers contain both styrene and eicosene moieties, an observation which is not consistent with the formation of homopolymers. This result and the observed DSC semicrystalline melting endotherms are both consistent with the formation of block copolymers containing multiple polystyrene and polyeicosene segments.

One preferred copolymer resin material evaluated as toner was a copolymer containing 75 weight percent of styrene and 25 weight percent of eicosene. This product, obtained in nearly quantitative yield, had a small semicrystalline endotherm in the DSC thermogram at 58° C. A toner made with 10 weight percent of Regal 330® carbon black and 16 weight percent of Mapico Black magnetite and 74 weight percent of the styrene-eicosene copolymer resin had a minimum fix temperature of 55° F. lower than a control toner sample prepared from 74 weight percent of a homopolymer of eicosene, 10 weight percent of Regal 330® carbon black, and 16 weight percent of Mapico Black, and had greater than a 75° F. fusing latitude.

The resin composition, DSC resin characterizations and fusing evaluations for the various block styrene and eicosene copolymers made with $TiCl_3$—AA/$Et_2AlCl$ are summarized in the following Table I.

The above copolymer was prepared, for example, by reacting eicosene and styrene, diethyl aluminum chloride and a catalytic amount of $TiCl_3$—AA (available from Alfa or Stauffer Chemical Company) of from about 0.01 to 5 weight percent based on the weight of total monomer used in the reaction. After one week at 25° C., the mixture was added to excess methanol, for example 5 to 50 weight percent excess, in a blender to precipitate the polymer which was then washed with water and then methanol, for example 5 to 50 weight percent excess of the expected product. The colorless polymer was isolated by filtration and then dried under vacuum. The material was characterized by $^1H$ NMR, solid state $^{13}C$ NMR spectrometry and DSC. Since the semicrystalline copolymer samples of the present invention had very low solubilities and GPC analysis requires a hot solution, GPC analysis was not performed. After extrusion in a Banbury rubber mill with 10 weight percent of Regal 330® carbon black and 16 weight percent of Mapico Black magnetite, and 74 weight percent of the above prepared copolymer at 120° C., the extrudate was then jetted into toner having a number average particle size diameter of 8 to 10 microns as determined by a Layson cell. A summary of the toner fusing results is found in Table I.

TABLE I

Preparation, DSC Characterization and Fusing Evaluation of Block Copolymers Made with Styrene, Eicosene and Isotactic Ziegler-Natta Catalyst $TiCl_3$-AA/$Et_2AlCl$.

| Styrene (g) | Eicosene (g) | Tmelt/Tglass °C. | Joules/ Gram | Fusing Evaluations |
|---|---|---|---|---|
| 0 | 10.0 (control) | 74.6 (Tm) | 106.4 | MFT<225° F. |
| 0.5 | 9.5 | 70.7 (Tm) | 98.5 | |
| 1.0 | 9.0 | 70.3 (Tm) | 53.0 | |
| 2.5 | 7.5 | 62.1 (Tm) | 40.1 | 275≦MFT≦ 300° F. |
| 5.0 | 5.0 | 58.2 (Tm) | 47.6 | Offsets all temp. |
| 7.5 | 2.5 | 58.8 (Tm) | N/A | 275° F. (MFT); 290° F. (superior fix) |
| 9.5 | 0.5 | 58.8 (Tg) | N/A | |
| 10.0 (Control) | 0 | 70.2 (Tg) | N/A | |

Eicosene-Undecylenol Copolymers

Specific eicosene copolymers prepared as illustrated herein included 5, 10, 15, 20, 25, 50 and 75 weight percent of undecylenol that was reacted in the protected form as the trimethyl silyl ether group, —$CH_2$—O—$Si(CH_3)_3$. The Ziegler-Natta $TiCl_3$—AA/$Et_2AlCl$ was the catalyst used. Analysis of the product polymers was accomplished with solid state CP/MAS $^{13}C$ NMR spectrometry, DSC, FTIR and melt rheology. The reagents and reaction conditions for the preparation of eicosene-undecylenol copolymers are found in Table IV.

TABLE IV

Reagents and Reaction Conditions for the Preparation of Eicosene-Undecylenol Copolymers

| Mol % Undecylenol Acid Accomplished | Toluene (g) | Eicosene (g) | Undecylenol T.M.S.-Ester (g) | $Et_2AlCl$ 1.8 Molar, (mL) | $TiCl_3AA$ Teaspoons | Yield (g) | Rxn Time, Hr |
|---|---|---|---|---|---|---|---|
| 5.3 | 61.5 | 19.00 | 1.01 | 25.0 | 1.00 | 14.7 | 2.50 |
| 11.1 | 58.3 | 20.00 | 2.21 | 25.0 | 1.00 | 18.0 | 3.3 |
| 15.0 | 60.0 | 17.10 | 3.00 | 25.0 | 1.00 | 12.1 | 1.3 |
| 19.2 | 60.0 | 16.00 | 4.04 | 25.0 | 1.00 | 11.1 | 17.3 |
| 14.3 | 60.0 | 16.07 | 4.02 | 25.0 | 1.00 | 14.5 | 2.5 |
| 25.6 | 60.0 | 15.07 | 5.03 | 25.0 | 1.00 | 10.7 | 3.5 |
| 24.3 | 63.0 | 18.78 | 6.25 | 12.5 | 1.25 | 18.5 | 72.0 |
| 44.0 | 60.0 | 10.07 | 10.10 | 30.0 | 1.50 | 12.3 | 3.0 |
| 82.6 | 60.0 | 5.00 | 15.00 | 50.0 | 3.00 | 10.8 | 4.5 |
| 100 | 80.0 | 0.00 | 15.00 | 70.0 | 2.25 | 8.3 | 2.5 |

The amount of the alcohol attached to the polymer was similar to the feed ratio charged at the beginning of the reaction. All of the polymers were brittle, melt extrudable and jettable. One resin polymer evaluated as toner was comprised of 74 weight percent of the above prepared (25.6 mol percent of undecylenol, 74.4 mol percent of eicosene) undecylenol-eicosene copolymer, 10 weight percent of carbon black, Regal 330®, and 16 weight percent of magnetite. The toner minimum fix temperature (MFT) was 225° F. and the hot offset (HOT) temperature was greater than 350° F. The copolymers in this class showed two DSC melting transitions between 39° and 87° C. Appreciable semicrystalline character is indicated in both homopolymer and copolymers prepared from these monomers.

The above polymers of the present invention, and others can be used as binders for Unilin® waxes (available from Petrolite Corporation), for example Unilin® 425, long chain fatty alcohols, for example, docosanol and fatty acids, for example docosanoic acid, in ultra low melt toner compositions, or they may be used as the sole resin component in toners. Toner image fix is superior or comparable with images made with ribbon-impact typewriters and the fused toner resin images are not prone to vinyl offset. A summary of toner fusing results is presented in Table II.

TABLE II

Fusing Evaluation of Toners Made with Eicosene-Undecylenol Copolymers

| Mol % Undecylenol Incorporated | Minimum Fix Temp., °F. | Hot Offset Temp., °F. |
|---|---|---|
| 0.53 | 225 | All Temp. |
| 11.1 | 225 | All Temp. |
| 15.0 | 200 | All Temp. |
| 19.2 | 200 | All Temp. |
| 14.3 | 225 | All Temp. |
| 25.6 | 225 | >350 |
| 24.3 | 225 | >350 |
| 44.0 | 225 | >350 |

TABLE II-continued

Fusing Evaluation of Toners Made with Eicosene-Undecylenol Copolymers

| Mol % Undecylenol Incorporated | Minimum Fix Temp., °F. | Hot Offset Temp., °F. |
|---|---|---|
| 82.6 | N.D.* | N.D.* |
| 100.0 (control) | >350 | All Temp. |

*N.D. = not determined; > highest temperature tested

Toners, average micron diameter of from about 10 to about 15 microns, were prepared with the indicated copolymer, 74 weight percent, 10 weight percent of Regal 330® carbon black and 16 weight percent of Mapico Black magnetite co-extruded at 120° C. followed by jetting and classification. "All Temp." refers to toner being offset, some toner removed from paper to fuser roll at fuser set temperature of from 200° F. to 350° F.

Eicosene-Undecylenic Copolymers

Copolymers of eicosene and undecylenic acid, reacted as the protected trimethyl silyl ester group —CO—O—$Si(CH_3)_3$, that is subsequently removed, were made using the aforementioned Ziegler-Natta isotactic catalyst. Specific copolymers prepared included 0, 3, 5, 8, 10, 13, 18, 27, 57 and 100 weight percent undecylenic acid groups. When charges of undecylenic acid as the trimethyl silyl ester were less than 50 weight percent of the total monomer composition, only about 53 weight percent of the total acid monomer charged became incorporated into the polymer chain. Analysis of these materials was carried out using solid state CP/MAS $^{13}C$ NMR spectrometry, DSC, FTIR and melt rheology. All of these materials were brittle, melt extrudable and processable into toners with Regal 330® carbon black and Mapico Black by jetting. DSC traces show two semicrystalline melt endotherms between 32° and 87° C. The size of the endotherm was dependent upon the amount of the undecylenic acid incorporated into the polymer chain. By contrast, polyundecylenic acid homopolymer shows two endotherms at −16° C. and 82° C. One preferred polymer was comprised of 10 weight percent undecylenic acid (90 weight percent)-eicosene copolymer. Toners as illustrated herein prepared with this material showed an MFT value at 175° F. (fuser set temperature) and a fusing latitude of greater than 150° F. By comparison, a control toner sample made from a homopolymer of eicosene with Regal 330® carbon black and Mapico Black showed an MFT at 330° F. under the same fusing conditions. A summary of compositions, DSC thermal analysis and toner fusing evaluations with styrene butadiene is shown in the following Table III.

Eicosene-Undecylenyl Iodide Copolymers and Derivatives

Eicosene was polymerized with 25 and 50 weight percent undecylenyl iodide derived from undecylenyl chloride. The aforementioned Ziegler-Natta isotactic catalyst was used, as described previously. Only 17 and 31 weight percent of undecylenyl iodide was incorporated into the polymers, respectively. The poly(eicosene-undecylenyl iodide) containing 17 weight percent of undecylenyl iodide was also used for the grafting polymerization forming pendant poly(ethyl oxazoline). Polyoxazoline side chains formed when the iodo polymer was heated with ethyl oxazoline at 110° C.

Undecylenyl iodide was reacted with triethylamine to form triethyl ammonium undecylenyl iodide. This monomer readily polymerized with eicosene in the presence of the aforementioned Ziegler-Natta catalyst without any appreciable catalyst poisoning.

The resultant iodo- and quaternary ammonium semicrystalline polymers were brittel and had two DSC melting transitions each between 30° C. and 81° C. A third transition at 117° C. was indicative of quaternary ammonium salt melting transition. The polymer with poly(ethyl oxazoline) grafts had an additional amorphous glass transition near 60° C.

The polymers were processed into toners by melt extrusion and jetting. The MFT of the resultant toners were less than 250° F. compared with 330° F. for that of the control toner made from an equivalent quantity of resin, 74 weight percent, comprised of 89 weight percent of styrene and 11 weight percent of butadiene copolymer, 10 weight percent of Regal 330® carbon black, and 16 weight percent of Mapico Black. The characterization and testing results for the copolymers and toners thereof are shown in Table III.

TABLE III

Composition, DSC Analysis, and Fusing Evaluations of Eicosene-Undecylenic Acid Copolymers

| $^{13}C$ NMR wt % Acid | Melting Temp., $T_M$, °C. | Blocking Temp., °C. | Min. Fix Temp. MFT, °F. | Hot Offset Temp. HOT, °F. |
|---|---|---|---|---|
| 3 | 39,76 | | 169 | >300 |
| 5 | 39,71 | | 200 | >350 |
| 8 | 39,71 | | 205 | >350 |
| 10 | 39,70 | | 200 | 326–350 |
| 11 | 39,65 | >50 | 175 | >350 |
| 13 | 39,65 | | 175 | >350 |
| 27 | 32,59 | >50 | 330 | >350 |
| 100 | −16,82 | >50 | N.D.* | N.D.* |
| 0 (control) | 51,87 | >50 | 180 | Offsets all temp. |

*N.D. - Not determined, composition not jettable

Typical properties of known crystalline polymers include a highly ordered solid state, a cloudy visual appearance, sharp melting points, and high heats required for known melting and proper fixing of toner images to paper. Typical properties of semicrystalline polymers include high melting points but less than those for the aforementioned crystalline materials and heats for fixing images to paper, low optical clarity and less crystallinity compared to crystalline polymers. The copolymers of the present invention have a semicrystalline character as determined by DSC but unexpectedly have small crystallites and some optical clarity as determined by visual inspection. These materials are preferably best suited for use in black toners wherein a no-gloss or matte finish is desirable.

The advantages of the copolymers of the present invention compared to the aforementioned crystalline copolymers as toner resins are, in embodiments for example, smaller crystallite size as evidenced by intermediate optical clarity and transparency; lower melting points; increased fusing latitudes; and lower energies of fusing and fusion without sacrificing jetting and processing characteristics. The copolymers poly($A_n$—$B_m$) of the present invention usually consume less energy, that is for example their heat of fusion is less than the homopolymers poly(A) or poly(B) individually or mixtures thereof of comparable molecular weight and polydispersity, a high heat of fusion being about 250 Joules/gram; the heat of fusion being the amount of heat needed to effectively and permanently fuse the toner composition to a supporting substrate such as paper. In addition, the aforementioned copolymers generally possess a number average molecular weight of from about 2,000 to about 1,500,000, and have a dispersity $M_w/M_n$ ratio believed to be of about 2 to about 15.

The aforementioned toner copolymer resins are generally present in the toner composition in various effective amounts depending, for example, on the amount of the other components. Generally, from about 70 to about 95 percent by weight of the copolymer resin is present, and preferably from about 80 to about 90 percent by weight.

Numerous well known suitable pigments or dyes can be selected as the colorant for the toner particles including, for example, carbon black such as those available from Cabot Corporation including Regal 330®, Black Pearls, and the like, nigrosine dye, lamp black, iron oxides, magnetites, and mixtures thereof. The pigment, which is preferably carbon black, should be present in a sufficient amount to render the toner composition highly colored. Thus, the pigment particles can be present in amounts of from about 2 percent by weight to about 20 percent by weight, and preferably from about 2 to about 10 weight percent based on the total weight of the toner composition, however, lesser or greater amounts of pigment particles may be selected in embodiments.

Various magnetites, which are comprised of a mixture of iron oxides ($FeO.Fe_2O_3$) in most situations, including those commercially available such as Mapico Black, can be selected for incorporation into the toner compositions illustrated herein. The aforementioned particles are present in various effective amounts; generally, however, they are present in the toner composition in an amount of from about 10 percent by weight to about 30 percent by weight, and preferably in an amount of from about 16 percent by weight to about 19 percent by weight. Other known magnetites not specifically disclosed herein may be selected.

A number of different charge enhancing additives may be selected for incorporation into, or onto (surface additive) the toner compositions of the present invention to enable these compositions to acquire a positive charge thereon of from, for example, about 10 to about 35 microcoulombs per gram. Examples of charge enhancing additives include alkyl pyridinium halides, especially cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate reference U.S. Pat. No. 4,560,635, the disclosure of which is totally incorporated herein by reference; distearyl dimethyl ammonium bisulfate in admixture with distearyl dimethyl ammonium methyl sulfate, reference U.S. Pat. No. 4,904,762, the disclosure of which is totally incorporated herein by reference; and other similar known charge enhancing additives. These additives are usually incorporated into the toner in an amount of from about 0.1 percent by weight to about 15 percent by weight, and preferably these additives are present in an amount of from about 0.2 percent by weight to about 5 percent by weight.

Moreover, the toner composition can contain as internal or external components other additives such as colloidal silicas inclusive of Aerosil, metal salts, metal salts of fatty acids such as zinc stearate, reference U.S. Pat. Nos. 3,590,000 and 3,900,588, the disclosures of which are totally incorporated herein by reference, and waxy components, particularly those with a molecular weight of from about 1,000 to about 15,000, and preferably from about 1,000 to about 6,000 such as polyethylene and polypropylene, which additives are generally present in an amount of from about 0.1 to about 5 percent by weight and preferably between 1 and 3 weight percent. Other additives include negative charge directing materials, for example TP-302 (NaChem), aluminum salt complexes, such as Bontron E-88, Bontron P-51, potassium tetraphenyl borate, quaternary ammonium salts such as distearyl dimethyl ammonium methyl sulfate and distearyl dimethyl ammonium hydrogen sulfate.

The toner composition of the present invention can be prepared by a number of known methods including melt blending the toner resin particles, and pigment particles or colorants, followed by mechanical attrition. Other methods include those well known in the art such as spray drying, melt dispersion, dispersion polymerization, extrusion, and suspension polymerization. In one dispersion polymerization method, a solvent dispersion of the resin particles and the pigment particles are spray dried under controlled conditions to result in the desired product.

Generally, in one preferred method for the preparation of toner compositions there was initially prepared the copolymer as described herein. Thereafter, there are admixed with the copolymer resin, pigment particles and other additives by, for example, melt extrusion, and the resulting particles are jetted and classified to enable toner particles, preferably with an average volume diameter of from about 8 to about 20 microns.

The copolymer can be mixed with 10 weight percent of Regal 330® carbon black and 16 weight percent of Mapico Black magnetite and then extruded at 120° C. for less than five minutes and preferably less than one minute. The extrudate can then be pulverized and then jetted into toners with a volume average particle size of between 11 and 15 microns and number average particle size of between 7 and 9 microns.

Heterogeneous, that is monomers in the solution phase and the catalyst as a solid phase, coordinative anionic polymerization of A and B monomers, utilizing Zeigler-Natta catalysts and conditions, allows for the preparation of poly(alpha-olefin) copolymers with a high degree of control over stereochemistry affording predominantly an isotactic product.

Important characteristics associated with the toner compositions of the present invention in embodiments thereof include a fusing temperature of less than about 200° F., and a fusing temperature latitude of about 150° F., that is for example in the range of from about 200 to about 350° F. The fusing temperature latitude is defined as the operating range difference between the hot offset temperature and minimum fusing temperature. Moreover, it is believed that the aforementioned toners possess stable triboelectric charging values of from about 10 to about 40 microcoulombs per gram for an extended number of imaging cycles exceeding, for example, in some embodiments one million developed copies. Negatively charging toner compositions may also be formulated by including known negative charge control additives in the bulk or on the surface of the toner or on the carrier beads. Although it is not desired to be limited by theory, it is believed that the slow, or substantially no degradation in the triboelectric charging values of the toners reside in such factors as the unique physical properties of the copolymer resin selected, the location of hydrocarbon rich resins on the triboelectric series, the very low affinity of the resins towards moisture and humidity, and moreover, the stability of the carrier particles utilized. Also of importance is the consumption of less energy with the toner compositions of the present invention since they can in embodiments be fused at a lower temperature, that is about 225° F. (fuser roll set temperature) compared with other conventional toners including those containing styrene butadiene resins, 10 weight percent of Regal 330® carbon black, 16 weight percent of magnetite, which fuse at from about 300 to about 330° F. In addition, they possess in some embodiments other important characteristics mentioned herein inclusive in some embodiments of a melting point range of from about 30° to about 100° C., and preferably from about 40° to about 60° C. Additionally, the toner resins of the present invention in some embodiments possess wax-like characteristics, that is the side chain functionality of copolymer resins impart waxlike properties in addition to the low melting characteristic to the toner composition. Thus, the need for external or internal wax additives for smear resistance as a release agent, or toner developer anticaking additive can be avoided as well as the problems and increased expense associated with internally or externally blending wax additives.

As carrier particles for enabling the formulation of developer compositions when admixed with the toner described herein, there are selected various known components including those wherein the carrier core is comprised of steel, nickel, magnetites, ferrites, copper zinc ferrites, iron, polymers, mixtures thereof, and the like. Also useful are the carrier particles as illustrated in U.S. Pat. Nos. 4,937,166 and 4,935,326, the disclosures of which are totally incorporated herein by reference. More specifically, these carrier particles can be prepared by mixing low density porous magnetic, or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F., for a period of from about 10 minutes to about 60 minutes enabling the polymers to melt and fuse to the carrier core particles; cooling the coated carrier particles; and thereafter classifying the obtained carrier particles to a desired particle size.

In a specific embodiment of the present invention, there are provided carrier particles comprised of a core with a coating thereover comprised of a mixture of a first dry polymer component and a second dry polymer component. Therefore, the aforementioned carrier compositions can be comprised of known core materials including iron with a dry polymer coating mixture thereover. Subsequently, developer compositions of the present invention can be generated by admixing the aforementioned carrier particles with the toner compositions comprised of the polyolefin copolymer resin particles and pigment particles.

Thus, a number of known suitable solid core carrier materials can be selected as indicated herein and in the U.S. patents recited. Characteristic carrier properties of importance include those that will enable the toner particles to acquire a positive or negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Preferred carrier cores include ferrites, and sponge iron, or steel grit with an average particle size diameter of from between about 30 microns to about 200 microns.

Illustrative examples of polymer coatings selected for the carrier particles of the present invention include those that are not in close proximity in the triboelectric series. Specific examples of polymer mixtures selected are polyvinylidene fluoride with polyethylene; polymethylmethacrylate and copolyethylenevinylacetate; copolyvinylidene fluoride tetrafluoroethylene and polyethylene; polymethylmethacrylate and copolyethylene vinylacetate; and polymethylmethacrylate and polyvinylidene fluoride. Other coatings, such as polyvinylidene fluorides, flourocarbon polymers including those available as FP-461, terpolymers of styrene, methacrylate, and triethoxy silane, polymethacrylates, reference U.S. Pat. Nos. 3,467,634 and 3,526,533, the disclosures of which are totally incorporated herein by reference, and not specifically mentioned herein can be selected providing the objectives of the present invention are achieved.

With further reference to the polymer coating mixture, by close proximity as used herein it is meant that the choice of the polymers selected are dictated by their position in the triboelectric series, therefore for example, one may select a first polymer with a significantly lower triboelectric charging value than the second polymer.

The percentage of each polymer present in the carrier coating mixture can vary depending on the specific components selected, the coating weight, and the properties desired. Generally, the coated polymer mixtures used contain from about 10 to about 90 percent of the first polymer, and from about 90 to about 10 percent by weight of the second polymer. Preferably, there are selected mixtures of polymers with from about 30 to about 60 percent by weight of the first polymer, and from about 70 to about 40 percent by weight of a second polymer. In one embodiment of the present invention, when a high triboelectric charging value is desired, that is exceeding 30 microcoulombs per gram, there is selected from about 50 percent by weight of the first polymer such as a polyvinylidene fluoride commercially available as Kynar 301F, and 50 percent by weight of a second polymer such as polymethylacrylate or polymethylmethacrylate. In contrast, when a lower triboelectric charging value is required, less than, for example, about 10 microcoulombs per gram, there is selected from about 30 percent by weight of the first polymer, and 70 percent by weight of the second polymer.

Generally, from about 1 part to about 5 parts by weight of toner particles are mixed with from about 10 to about 300 parts by weight of the carrier particles illustrated herein enabling the formation of developer compositions.

Also encompassed within the scope of the present invention are colored toner compositions comprised of toner copolymer resin particles, and as pigments or colorants, red, blue, green, brown, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as CI 60720; CI Dispersed Red 15, a diazo dye identified in the Color Index as CI 260; CI Solvent Red 19; and the like. Examples of cyan materials that may be used as pigments include copper tetra-4-(octadecyl sulfonamido) phthalocyanine; X-copper phthalocyanine pigment listed in the Color Index as CI 74160; CI Pigment Blue; and Anthracene Blue, identified in the Color Index as CI 69810; Special Blue X-2137; and the like; while illustrative examples of yellow pigments that may be selected are diarylide yellow 3,3-dichlorobenzidene acetoacetanilides, a monoazo pigment identified in the Color Index as CI 12700; CI Solvent Yellow 16, a nitrophenyl amine sulfonamide identified in the Color Index as Foron Yellow SE/GLN; CI Dispersed Yellow 33, a 2,5-dimethoxy-4-sulfonanilide phenylazo-4'-chloro-2,5-dimethoxy acetoacetanilide; Permanent Yellow FGL; and the like. These pigments are generally present in the toner composition in an amount of from about 1 weight percent to about 15 weight percent based on the weight of the toner resin particles.

The toner and developer compositions of the present invention may be selected for use in electrophotographic imaging processes containing therein conventional photoreceptors, including inorganic and organic photoreceptor imaging members. Examples of imaging members are selenium, selenium alloys, such as selenium tellurium, selenium arsenic, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl amines disclosed in the '990 patent. Also, there can be selected as photogenerating pigments, squaraine compounds, azo pigments, perylenes, thiapyrillium materials, and the like. These layered members are conventionally charged negatively, thus usually a positively charged toner is selected for development. Moreover, the developer compositions of the present invention, are particularly useful in electrophotographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference. Images obtained with the developer compositions of the present invention possess acceptable solids, excellent halftones and desirable line resolution with acceptable or substantially no background deposits.

For imaging and printing processes wherein it is desired to further avoid the use of release fluids and the costly apparatus associated therewith the toners of the present invention may include additionally low molecular weight waxes, such as polypropylene, polyethylene, and the like, with a weight average molecular weight of for about 1,000 to about 7,000, and which waxes are usually present in an amount of from about 1 to about 10 weight percent. However, as indicated above, many of the copolymer toner resins of the present invention possess wax-like lubricant properties, which properties allow minimizing the reliance upon or avoidance of release agent fluids or the addition of separate wax phase to the toner composition.

The following examples are being supplied to further define the present invention, it being noted that these examples are intended to illustrate and not limit the scope of the present invention. Parts and percentages are by weight unless otherwise indicated. Also, comparative data and Examples are presented.

EXAMPLE I

General Procedure for the Preparation of Eicosene and Styrene Copolymers and Xerographic Toner Therefrom To a 100 milliliter screw cap bottle containing toluene was added eicosene (2.5 grams), styrene (7.5 grams), diethylaluminum chloride (8 milliliters of 1.8 molar solution in toluene) and 1 gram (¼ teaspoon) of the catalyst $TiCl_3AA$ (available from Alfa Corporation). After 1 week at 25° C., the mixture was added to methanol (2,000 milliliters) in a blender to precipitate the polymer which was subsequently washed with water (1,000 milliliters) and then methanol (2,000 milliliters). The white polymer isolated by filtration was then dried in vacuum. The polymer shows a small endotherm in the DSC trace at 58° C. indicated of semicrystalline character. After melt extrusion of the copolymer resin, 74 weight percent, with 10 weight percent of Regal 330® carbon black and 16 weight percent of Mapico Black magnetite at 120° C., the extrudate was pulverized in a Waring blender and jetted to 8 micron particles. A positively charged toner and developer were then prepared by treating the jetted toner (2 grams) with 1:1 weight ratio of Aerosil R972 (available from DeGussa) and TP-302 charge control agent (Nachem, 0.06 gram) and admixing therewith 70:30 Kynar/PMMA coated steel carrier (60 grams). A tribocharge value of 20 microcoulombs per gram was measured with the standard known Faraday Cage blow-off apparatus. Xerox Corporation Model D images were made using a "negative" target and cascade development of a selenium photoreceptor under standard development conditions (5 to 10 second light exposure and a negative bias to transfer the positive toned images from photoreceptor to paper). Fusing evaluations were then carried out with a Xerox Corporation model 5028® soft silicone roll fuser set at 250° F. (cold offset), 275° F. (approximate minimum fix temperature, no offset), 290° F. (excellent image fix), 300° F. (no offset), 325° F. (no offset) and 350° F. (no hot offset). Fuser set temperature was determined with an Omega pyrometer.

Composition amounts of styrene and eicosene in the copolymers were determined by $^1H$ NMR spectrometry with samples of the copolymer dissolved in $CDCl_3$ and by solid state cross-polarization $^{13}C$ NMR spectrometry with powdered samples of the copolymers packed in a sapphire rotor. The weight percent of styrene obtained in the copolymers was comparable with the feed ratio of styrene charged at the beginning of the reaction between 10 and 75 weight percent of styrene loadings. Table I shows a summary of the preparations, weight percentages, thermal properties, and toner fusing evaluations of the polymers and toners made with styrene, eicosene and the isotactic Ziegler-Natta catalyst $TiCl_3$ $AA/Et_2AlCl$.

Positively charged toners were also prepared by repeating the above procedure with the exception that there was included therein 2 percent by weight of the charge enhancing additive cetyl pyridinium chloride, and 8 percent by weight of carbon black particles in place of the TP-302 charge control agent and 10 percent by weight of carbon black. A tribocharge value of about 20 microcoulombs per gram was measured with a standard Faraday Cage blow-off apparatus.

EXAMPLE II

Preparation of Undecylenyl Chloride

A one liter, three necked flask equipped with mechanical stirrer, reflux condenser, argon inlet and addition funnel was heated in an oil bath at 50° C. To the flask was added methylene chloride (400 milliliters), undecylenol (100 grams) and pyridine (55.7 grams). Thionyl chloride (78.9 grams) in methylene chloride (100 milliliters) was added dropwise under reflux over five hours. The mixture was filtered, the solvent was removed from the filtrate using a rotary evaporator, and the resultant oil was refiltered and then distilled using a packed column to yield two fractions. A fraction collected between 100° and 110° C. and about 1 millimeter of mercury was redistilled to yield 40 grams of undecylenyl chloride as an oil obtained at 80° to 85° C. at about 1 millimeter of mercury.

EXAMPLE III

Preparation of Undecylenyl Iodide

In a 250 milliliter three necked round bottom flask equipped with mechanical stirrer, reflux condenser, and addition funnel were placed sodium iodide (54.0 grams, 0.29 mol, 1.26 equivalents) and acetone (75 milliliters). Undecylenyl chloride (43 grams) was added dropwise and the mixture was refluxed for 16 hours. More sodium iodide (9 grams) was then added and refluxing continued for four days. Methylene chloride was added and the reaction mixture was filtered. Solvent was removed from the filtrate and the residue was vacuum distilled. Two fractions were collected between 87° and 93° C. and between 95° and 98° C. at 1 millimeter of mercury. Both fractions contained the undecylenyl iodide as a light yellow oil.

A related procedure where the undecylenyl iodide was prepared in methyl ethyl ketone as solvent was accomplished as follows: in a 250 milliliter three necked round bottom flask equipped with mechanical stirrer, reflux condenser, argon inlet, and addition funnel were placed sodium iodide (27 grams) methyl ethyl ketone (175 milliliters) and 11-undecylenyl chloride (17.34 grams, 0.089 mol). The reaction mixture was refluxed for 40 hours then stirred at 25° C. for 3 days. After filtration the solvent was removed by vacuum evaporation and the residue was vacuum distilled. The fraction collected between 136° and 144° C. at 1 millimeter of mercury was the desired undecylenyl iodide (10.6 grams).

EXAMPLE IV

Preparation of Triethyl Ammonium Undecylenyl Iodide

A solution of 11-undecylenyl iodide (15 grams), ethanol (120 milliliters), and triethylamine (55 grams) was placed in a 500 milliliter three necked round bottom flask equipped with mechanical stirrer and reflux condenser. The reaction mixture was refluxed for 46 hours, then cooled. The solvent was removed by vacuum evaporation and the residue was washed with diethyl ether and hexanes to afford a brown-yellow colored solid. The solid was dissolved in toluene and then mixed with diethyl ether and hexanes to precipitate a fine, off-white colored solid. After filtration and washing with diethyl ether, the solid was dried in vacuo to yield 12.5 grams of the above desired ammonium undecylenyl iodide product.

EXAMPLE V

Preparation of Undecylenyl Acid-Trimethylsilyl Ester

To a 3 liter three necked round bottom flask equipped with an addition funnel, mechanical stirrer, and reflux condenser were added undecylenic acid (Lucidol, 480 grams, 2.6 mol), pyridine (240 grams, 3.03 mol) and toluene (900 milliliters). Trimethylsilyl chloride (326 grams, 3.0 mol) was then added slowly via the addition funnel over 2.5 hours. After stirring at 25° C. for 16 hours, the precipitate was filtered off and washed with toluene. The filtrates were combined and toluene was removed using a rotary evaporator. The residue was distilled and collected from 25° to 115° C. at about 1 millimeter of mercury. A second cut was collected between 115° and 119° C. at about 1 millimeter of mercury. The third cut, collected at between 115° and 120° C. at about 1 millimeter mercury, was identified by IR 1,640 $cm^{-1}$ (ester C=O), $^{13}C$ and $^{1}H$ spectrometries as the trimethylsilyl ester of undecylenic acid (320.4 grams) with no indication of the presence of the free acid in this fraction.

EXAMPLE VI

General Procedure for the Preparation of Poly(Undecylenyl Acid-Eicosene) Copolymers To a glass screw top jar were added toluene solvent, trimethylsilyl undecylenic acid ester (T.M.S.), and liquified eicosene. Under argon atmosphere were added diethyl aluminum chloride (1.8 molar solution in toluene) and $TiCl_3$—AA (available from Alfa). The reaction mixture was stirred for several hours. Methanol was added dropwise until the mixture turned green. The green reaction mixture was then added to methanol/hydrochloric acid in a Waring blender to precipitate the solid polymer. After washing with methanol, water and then methanol in the blender and filtration, the isolated polymer was dried in vacuo to yield the semicrystalline copolymer product. The quantities of reagents used, reaction times and physical and fusing properties of the eicoseneundecylenic acid copolymers are shown in Tables V and III, respectively. The products were characterized by DSC, IR, solid state $^{13}C$ NMR and $^{1}H$ NMR.

TABLE V

Reagents and Reaction Conditions for the Preparation of Eicosene-Undecylenic Acid Copolymers

| Wt % Undecylenic Acid Added | Wt % Undecylenic Acid Incorporated | Toluene (g) | Eicosene (g) | Undecylenic Acid T.M.S.-Ester (g) | $Et_2AlCl$ 1.8 Molar (mL) | $TiCl_3AA$ Teaspoons | Yield (g) | Rxn Time, Hr. |
|---|---|---|---|---|---|---|---|---|
| 5.0 | 3 | 53 | 19.10 | 1.03 | 30 | 1.00 | 16.74 | 2.50 |
| 10.0 | 5 | 53 | 18.04 | 2.09 | 30 | 1.00 | 16.06 | 1.50 |
| 15.0 | 8 | 53 | 17.01 | 3.10 | 25 | 1.00 | 14.87 | 2.75 |
| 20.0 | 10 | 53 | 16.22 | 4.05 | 25 | 1.00 | 14.62 | 3.75 |
| 25.0 | 13 | 107 | 30.30 | 10.10 | 50 | 2.00 | 23.35 | 1.50 |
| 24.0 | 12 | 53 | 20.80 | 6.50 | 25 | 1.25 | 21.25 | 1.00 |
| 25.0 | 11 | 63 | 19.00 | 6.40 | 23 | 1.00 | 19.73 | 16.00 |
| 25.0 | 13 | 63 | 19.20 | 6.50 | 25 | 1.25 | 21.33 | 4.00 |
| 35.0 | 18 | 58 | 13.00 | 7.00 | 25 | 1.50 | 11.07 | 3.00 |
| 48.6 | 26 | 116 | 17.66 | 16.70 | 25 | 1.25 | N.A. | 0.50 |
| 50.0 | 27 | 63 | 5.00 | 5.00 | 22 | 2.00 | 5.49 | 4.00 |
| 75.0 | 57 | 63 | 2.50 | 7.50 | 36 | 1.50 | 3.75 | 6.00 |
| 100.0 | 100 | 63 | 0.00 | 10.00 | 48 | 2.00 | 2.62 | 7.00 |

EXAMPLE VII

Preparation of Poly(Undecylenyl Iodide-Eicosene) Copolymer

To a glass screw top jar were added undecylenyl iodide (6.3 grams), toluene solvent (63.1 grams), and eicosene (18.73 grams). Under argon atmosphere were added diethyl aluminum chloride (25 milliliters of a 1.8 molar solution in toluene) and 1.25 teaspoons of $TiCl_3$—AA (available from Alfa, about 5 grams). The sealed jar was stirred for 2 hours. Methanol was added dropwise until the mixture turned green. The reaction mixture was then added to methanol/hydrochloric acid in a Waring blender to precipitate the solid polymer. In the blender, the polymer was washed successively with methanol, water and then methanol. After filtration, the isolated polymer was dried in vacuo to yield 21.04 grams of the semicrystalline polymer product, poly(undecylenyl iodide-eicosene) copolymer, the DSC of this product indicated two semicrystalline endotherms at 30° and 55° C. Solid state $^{13}C$ NMR analysis measured 17 weight percent of $CH_2$—I groups present.

EXAMPLE VIII

Preparation of Poly (31 Percent Weight of Undecylenyl Iodide-Eicosene) Copolymer To a glass screw top jar were added undecylenyl iodide (5 grams), toluene solvent (30 grams) and eicosene (5 grams, Aldrich Chemical). Under argon atmosphere were added diethyl aluminum chloride (10 milliliters of a 1.8 molar solution in toluene) and 0.5 teaspoon of $TiCl_3$—AA (available from Alfa, about 2 grams). Two additional charges of both catalysts were added in 90 minute intervals and then the reaction mixture was stirred for 16 hours at 25° C. Methanol was added and the mixture was precipitated into methanol/hydrochloric acid using a Waring blender. The solids were sequentially washed with methanol, water and then methanol using a blender and the residue was isolated by filtration and dried in vacuo to yield 6.26 grams of the grey rubbery product, poly(undecylenyl iodide-eicosene) copolymer. $^{13}C$ NMR (in deuterated chloroform) analysis measured a ratio of $CH_2$—I groups to $CH_3$ groups present to be 31 weight percent.

EXAMPLE IX

Preparation of Poly (Undecylenyl Triethyl Ammonium Iodide-Eicosene) Copolymer Triethyl ammonium undecylenyl iodide (7.5 grams), eicosene (22.5 grams) and toluene (60 grams) were added to a glass screw cap jar under an argon atmosphere. Diethyl aluminum chloride (25 milliliters of a 1.8 molar solution in toluene) and 1.25 teaspoons of $TiCl_3$—AA (available from Alfa, about 5 grams) were added. After 1.5 hours, the reaction was treated with methanol until the mixture turned green. The mixture was added to methanol in a Waring blender to precipitate the polymer which was washed successively with water and then methanol. The solid polymer was isolated by filtration and dried in vacuo to afford 19 grams of a white powder. Solid state $^{13}C$ NMR analysis was consistent with the attachment of 5 weight percent of quaternary ammonium groups. The DSC of this product showed two semicrystalline melting endotherms at 45° and 81° C. and a melting peak at 117° C. attributed to the quaternary ammonium iodide group.

EXAMPLE X

Preparation of Poly (25 Percent Weight of Undecylenyl Iodide-Eicosene)Graft-Polyethyloxazoline Copolymer A 250 milliliters round bottom flask equipped with a mechanical stirrer and reflux condenser was placed in an oil bath. Poly (25 weight percent Undecylenyl Iodide-Eicosene) polymer (5 grams) and freshly distilled 2-ethyloxazoline (5 grams) were added and the reaction mixture heated to 80° C. for one hour and then one hour at 110° C. After 16 hours at 110° C., the residue was pulverized in a Waring blender to yield 9.2 grams of a brittle solid. The melt rheology data indicated a melt viscosity ($\eta'$ at 10 radians per second) of $7.5\times10^4$ poise at 67° C. compared with 104° C. for that of a conventional 11 weight percent of butadiene-styrene (89/11) emulsion copolymer of Pliolite (available from Goodyear). The melt viscosity profile of this polymer as toner is comparable with that of a control toner having the same composition and additives as described below with the only differences being the copolymer resin is Pliolite, and the toner profile is offset by more than 37° C. This polymer is further characterized as a semicrystalline polymer with glassy grafts, that is a glass transition temperature of about 60° C.

EXAMPLE XI

Magnetic Toner Preparation and Evaluation

Copolymers, 74 weight percent in each instance, prepared in accordance with the process of Examples VII, IX, and X above were melt extruded with 10 weight percent of Regal 330® carbon black and 16 weight percent of Mapico Black magnetite at 120° C., and the extrudate was pulverized in a Waring blender and then jetted to 8 micron number average sized particles. A positively charging toner was prepared by surface treating the jetted toner (2 grams) with 0.12 gram of a 1:1 weight ratio of Aerosil R972 (Degussa) and TP-302 (Nachem/Hodogaya) charge control agent.

Developer compositions were then prepared by admixing 3.34 parts by weight of the aforementioned toner composition with 96.66 parts by weight of a carrier comprised of a steel core with a polymer mixture thereover containing 70 percent by weight of Kynar, a polyvinylidene fluoride, and 30 percent by weight of polymethyl methacrylate; the coating weight being about 0.9 percent. A tribocharge value of about 20 microcoulombs per gram was measured with a standard Faraday Cage blow-off apparatus. Cascade development was used to develop a Xerox Corporation Model D selenium photoreceptor using a "negative" target. The light exposure was set between 5 and 10 seconds and a negative bias was used to dark transfer the positive toned images from the photoreceptor to paper.

Fusing evaluations were then carried out with a Xerox Corporation 5028® soft silicone roll fuser operated at 3 inches per second, set at 250° F. (cold offset), 275° F. (approximate minimum fix temperature, without offset), 290° F. (superior image fix), 300° F. (no offset), 325° F. (no offset) and 350° F. (no hot offset).

The minimum fix and hot offset temperatures (in °F.) of the eicosene-undecylenyl iodide derivative polymers and styrene butadiene (89/11) as toners are tabulated in Table VI.

TABLE VI

Fusing Evaluation of Eicosene - Undecylenyl Iodide Derivatives as Toner

| Resin as Toner See Example No.* | MFT (°F.) | HOT (°F.) |
|---|---|---|
| VII | 250 | 290 |
| IX | 190 | 230 |
| X | 250 | >350 |
| Styrene-Butadiene copolymer control (wt % St-Bu = 89:11) | 330 | 360-380 |

*toner composition - 10 weight percent of Regal 330® carbon black, 16 weight percent of Mapico Black magnetite and 74 weight percent of the indicated copolymer.
MFT - minimum fix temperature
HOT - hot offset temperature The actual roll temperature was determined using an Omega pyrometer and was checked with wax paper indicators. The degree to which the developed toner image adhered to paper after fusing was evaluated using a Scotch® tape test. The fix level was found to be excellent and comparable to that fix obtained with typewriter ribbon generated images on paper, that is greater than 95 percent of the toner image remained fixed to the copy sheet after removing a tape strip as determined by a densitometer.

Also, images were developed with the above prepared toners of the present invention in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate Makrolon, reference U.S. Pat. No. 4,265,990, the disclosure of which is totally incorporated herein by reference; and there resulted images of excellent quality with no background deposits and of high resolution for an extended number of imaging cycles exceeding, it is believed, about 75,000 imaging cycles.

The poly(alpha-olefins) of the present invention in embodiments may also, it is believed, find other uses such as, for example, in motor oils, greases, hydraulic fluids, lubricants and the like.

Other modifications of the present invention may occur to those skilled in the art subsequent to a review of the present application, and these modifications are intended to be included within the scope of the present invention.

What is claimed is:

1. A toner composition consisting essentially of semicrystalline copolymer resin particles with a melting point of from about 30° C. to about 100° C. wherein the copolymer resin is of the formula ($A_n$—$B_m$) wherein A represents eicosene, and B represents at least one monomer selected from the group consisting of styrenes and functionalized olefins, and wherein said olefins contain functional groups of hydroxy, carboxy, amino, amido, ammonium or halo, and n represents the number of A monomers, and m represents the number of B monomers; and pigment particles.

2. A toner composition in accordance with claim 1 wherein n is a number of from about 10 to about 2,100.

3. A toner composition in accordance with claim 1 wherein m is a number of from about 10 to about 2,100.

4. A toner composition in accordance with claim 1 wherein the A monomers are comprised of eicosene.

5. A toner composition in accordance with claim 1 wherein the B monomers are selected from the group consisting of styrene, undecylenyl alcohol, undecylenyl halide, undecylenic acid, metal salts of undecylenic acid, alkyl and aryl undecylenic acid esters, trialkyl silyl undecylenic acid esters, iodoeicosene, quaternary ammonium undecylenyl salts, amino undecylene, and amido undecylene.

6. A toner composition in accordance with claim 1 wherein the copolymer is a mixed poly(alpha-olefin) copolymer comprised of components selected from the group consisting of eicosene and styrene; eicosene and undecylenyl halides; eicosene and undecylenyl alcohol; eicosene and undecylenyl acid; eicosene and alkali metal salts of undecylenyl acid; eicosene and alkyl and aryl undecylenic acid esters; eicosene and trialkylsilyl undecylenic acid esters; eicosene and iodo-eicosene; eicosene and quaternary ammonium undecylene; eicosene and amino undecylene; and eicosene and amido undecylene.

7. A toner composition in accordance with claim 1 wherein the resin particles are of a number average molecular weight of from about 2,000 to about 1,500,000.

8. A toner composition in accordance with claim 1 wherein the resin particles dispersity ratio $M_w/M_n$ is from about 2 to about 15.

9. A toner composition in accordance with claim 1 wherein the pigment particles are selected from the group consisting of carbon black, magnetites, and mixtures thereof.

10. A toner composition in accordance with claim 1 wherein the pigment particles are selected from the group consisting of red, blue, green, brown, cyan, magenta, yellow, and mixtures thereof.

11. A toner composition in accordance with claim 1 wherein the resin particles are present in an amount of from about 70 to about 90 percent by weight.

12. A toner composition in accordance with claim 1 wherein pigment particles are present in an amount of from about 2 to about 30 percent by weight.

13. A toner composition in accordance with claim 2 containing charge enhancing additives.

14. A toner composition in accordance with claim 1 containing charge enhancing additives.

15. A toner composition in accordance with claim 14 wherein the charge enhancing additives are selected from the group consisting of alkyl pyridinium halides, organic sulfates, organic sulfonates, distearyl dimethyl ammonium bisulfate and distearyl dimethyl ammonium methyl sulfate, cetyl pyridinium lakes, Fanal Pink, polyvinyl pyridine, treated carbon blacks, tetraphenyl borate salts, phosphonium salts, nigrosine, metal-salicylate salts, aluminum complex salts, polystryene-polyethyleneoxide block copolymer salt complexes, poly(-dimethyl amino methyl methacrylate), metal azo dye complexes, organo-aluminum salts, Aerosils, fluorosurfactants and zinc stearate.

16. A toner composition in accordance with claim 15 wherein the charge enhancing additive is present in an amount of from about 0.1 to about 10 percent by weight.

17. A toner composition in accordance with claim 1 wherein the triboelectric charge on the toner is from about a positive or negative 5 to about 35 microcoulombs per gram.

18. A toner composition in accordance with claim 1 wherein the toner composition has a fusing temperature of about 200° F.

19. A toner composition in accordance with claim 1 wherein the toner composition has a fusing temperature of from about 200 to about 250° F.

20. A developer composition comprised of the toner composition of claim 1, and carrier particles.

21. A developer composition in accordance with claim 20 wherein the carrier particles are comprised of a core of steel, iron, or ferrites.

22. A developer composition in accordance with claim 20 wherein the carrier particles include thereover a polymeric coating.

23. A developer composition in accordance with claim 20 wherein the pigment particles for the toner are carbon black, magnetites, or mixtures thereof.

24. A developer composition in accordance with claim 20 wherein the toner contains a charge enhancing additive selected from the group consisting of alkyl pyridinium halides, organic sulfates and sulfonates, distearyl dimethyl ammonium bisulfate and distearyl dimethyl ammonium methylsulfate, aluminum salt complexes, and tetraphenyl borate salts.

25. A developer composition in accordance with claim 24 wherein the charge enhancing additive is cetyl pyridinium chloride.

26. A developer composition in accordance with claim 20 wherein the carrier particles are prepared by a process which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F., whereby the polymer mixture melts and fuses to the carrier core particles; and (4) thereafter cooling the resulting coated carrier particles.

27. A method for developing images which comprises the formation of an electrostatic latent image on a photoconductive member; developing the resulting image with the toner composition of claim 1; subsequently transferring the developed image to a suitable substrate; and thereafter permanently affixing the image thereto.

28. A method of imaging in accordance with claim 27 wherein the developer composition maintains its electrical characteristics for one million copies.

29. A toner composition in accordance with claim 1 wherein the resin particles are of a number average molecular weight of from about 10,000 to about 100,000.

30. A toner composition in accordance with claim 1 wherein the copolymer is comprised of components selected from the group consisting of eicosene of from about 25 to about 90 weight percent and styrene; eicosene and undecylenyl halides of from about 10 to about 50 weight percent; eicosene and undecylenyl alcohol of from about 10 to about 45 weight percent; eicosene and undecylenyl acid of from about 2 to about 30 weight percent; eicosene and alkali metal salts of undecylenyl acid of from about 2 to about 30 weight percent; eicosene and alkyl and aryl undecylenic acid esters of from about 2 to about 30 weight percent; eicosene and trialkylsilyl undecylenic acid esters of from about 2 to about 30 weight percent; eicosene and iodoeicosene of from about 10 to about 50 weight percent; eicosene and quaternary ammonium undecylene of from about 2 to about 50 weight percent; eicosene and amino undecylene of from about 10 to about 50 weight percent; and eicosene and amido undecylene of from about 10 to about 50 weight percent and eicosene and undecylenyl halides of from about 10 to about 50 weight percent containing graft polyethyloxazoline.

31. A toner composition in accordance with claim 1 wherein the toner resin is comprised of A monomers of eicosene, B monomers of undecylenyl halides and side chain graft segments of polyethyloxazoline.

32. A toner composition in accordance with claim 1 wherein the toner has a heat of fusion of about 30 to about 200 Joules/gram.

33. A toner composition in accordance with claim 1 wherein the copolymer is comprised of poly(undecylenyl iodide-eicosene), poly(undecylenyl triethyl ammonium iodide-eicosene), or undecylenyl iodide-eicosene-graft-polyethyloxazoline copolymer.

34. A toner composition consisting essentially of semicrystalline copolymer resin particles with a melting point of from about 30° C. to about 100° C., and containing functional groups selected from the group consisting of hydroxy, carboxy, amino, amido, ammonium and halo wherein the copolymer resin is a poly(alpha-olefin) of the formula ($A_n$—$B_m$) wherein A represents at least one monomer, B represents at least one B monomer, n represents the number of A monomers, and m represents the number of B monomers, and pigment particles; and wherein A is eicosene and the functional groups are present on B.

* * * * *